US006624596B1

(12) United States Patent
Ohsawa et al.

(10) Patent No.: US 6,624,596 B1
(45) Date of Patent: Sep. 23, 2003

(54) DEVICE FOR LIGHTING DISCHARGE LAMP

(75) Inventors: Takasi Ohsawa, Tokyo (JP); Yoshihisa Kawasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/110,432

(22) PCT Filed: Aug. 17, 2000

(86) PCT No.: PCT/JP00/05516

§ 371 (c)(1),
(2), (4) Date: Apr. 12, 2002

(87) PCT Pub. No.: WO02/15647

PCT Pub. Date: Feb. 21, 2002

(51) Int. Cl.[7] ..... H05B 4/16; H01F 27/24

(52) U.S. Cl. ..... 315/276; 315/289; 315/78; 336/212; 336/220; 336/221; 336/195

(58) Field of Search ..... 315/276, 289, 315/278, 56, 82, 78, 77; 336/180, 182, 183, 185, 186, 192, 195, 196, 199, 213, 220, 221

(56) References Cited

U.S. PATENT DOCUMENTS 6,191,675 B1 * 2/2001 Sudo et al. ..... 336/96

FOREIGN PATENT DOCUMENTS

| | | |
|---|---|---|
| JP | 62-293705 | 12/1987 |
| JP | 8-51035 | 2/1996 |
| JP | 2001-257088 | * 9/2001 |

* cited by examiner

*Primary Examiner*—Don Wong
*Assistant Examiner*—Tuyet T. Vo
(74) *Attorney, Agent, or Firm*—Sughrue Mion, PLLC

(57) ABSTRACT

The discharge lamp lighting device according to the present invention is provided with a high-voltage generating transformer which comprises a core, a secondary winding part disposed in a plurality of sections on the outside of the core, and a primary winding part disposed on the outside of the secondary winding part and in which a high-voltage side terminal of said secondary winding part is connected to a terminal of the core and a low-voltage side terminal of the secondary winding part is connected to a terminal of the primary winding part.

6 Claims, 4 Drawing Sheets

DEVICE FOR LIGHTING DISCHARGE LAMP

TECHNICAL FIELD

The present invention relates to a discharge lamp lighting device for lighting a discharge lamp that is used as a headlight of an automobile or similar vehicle.

BACKGROUND ART

Among discharge lamps, such high intensity discharge lamps (HIDs) as a metal halide lamp, high pressure sodium lamp, mercury vapor lamp have been used as lights for outdoor and indoor facilities, warehouses, factories etc., and as streetlights, and so forth since they have the advantages of large luminous flux, high lamp efficiency and longevity. In recent years, they have come into use, in particular, as headlights of automobiles and the like. To light discharge lamps of this kind, a high starting voltage needs to be applied on startup—this necessitates the use of a lighting device provided with an igniter for generating the starting voltage as well as a stabilizer for stable lighting of the discharge lamp.

FIG. 1 is a sectional view showing the internal construction of a high-voltage generating transformer that is used as an igniter for a conventional lighting device. In FIG. 1, reference numeral 1 denotes a high-voltage generating transformer. The high-voltage generating transformer 1 is composed mainly of a columnar core disposed centrally thereof, a primary winding part 3 disposed around the core 2, a secondary winding part 4 disposed outside the primary winding part 3, and an insulator 5 for insulating the secondary winding part 3 and the primary winding part 3 from each other.

Since the high-voltage generating transformer 1 in the conventional lighting device has such a construction as mentioned above, the secondary winding part 4 for high voltage generating use is so close to the core 2 of low voltage and the periphery of the core 2 that it is necessary to put a distance of insulation L against high voltage between the core 2 and the secondary winding part 4 and between the secondary winding part 4 and the core periphery; hence, the insulator 5 of some thickness is indispensable, giving rise to a problem that the prior art transformer cannot meet the demand for miniaturization of the discharge lamp lighting device for automobiles or the like.

In the accommodation of such a request, the high-voltage generating transformer for the discharge lamp lighting device causes magnetic flux emanating from the primary winding part 3 to cross the secondary winding part 4 to generate a high voltage in the secondary winding part 4 through electromagnetic induction, and hence the transformer is required to maintain the transformer coupling property and have dielectric strength against the high voltage.

The present invention is intended to solve such problems as mentioned above, and has for its object to provide a small-size discharge lamp lighting device that permits generation of high voltage.

DISCLOSURE OF THE INVENTION

A discharge lamp lighting device according to an aspect of the present invention is characterized by the provision of a high-voltage generating transformer comprising a core, a secondary winding part disposed in a plurality of sections on the outside of said core, and a primary winding part disposed outside said secondary winding part, wherein a high-voltage side terminal of said secondary winding part is connected to a terminal of said core and a low-voltage side terminal of said secondary winding part is connected to a terminal of said primary winding part. With this construction, it is possible to reduce the insulation capacity in the high-voltage generating transformer and decrease the number of parts such as insulating members, achieving miniaturization of the transformer. Further, since the secondary winding part disposed on the core is divided into a plurality of sections, it is possible to suppress the potential difference between the beginning and end of the winding in each section and increase the withstand voltage of the entire secondary winding part 24 by increasing the number of winding grooves. Furthermore, since the primary winding part is disposed in the same space as that of the secondary winding divided by the respective sections of the winding grooves, it is possible to increase the power transfer efficiency from the primary winding part to the secondary winding part and hence improve the transformer coupling property. Additionally, since the primary winding part is disposed on the secondary winding part over plural sections, it is possible to cause the magnetic flux emanating from the primary winding part to cross the secondary winding part 23 over a wide range, thereby permitting generation of a high voltage from the secondary winding part through electro-magnetic induction.

A discharge lamp lighting device according to another aspect of the present invention is characterized in that the primary winding is disposed substantially uniformly all over the secondary winding part on the outside thereof. With this structure, the magnetic flux emanating from the primary winding part 24 can also be made uniform and the magnetic flux crossing the secondary winding part 24 increases, providing enhanced power transfer efficiency.

A discharge lamp lighting device according to another aspect of the present invention is characterized in that the primary winding part is formed by a high withstand-voltage electric wire. Since this enables the primary winding part to withstand a high voltage generated in the secondary winding part, the primary winding part can be disposed, without a hitch, in plural sections from the low-voltage side to the high-voltage side of the secondary winding part.

A discharge lamp lighting device according to another aspect of the present invention is characterized in that the high withstand-voltage electric wire includes a first insulating layer covering a conductor and a second insulating layer coated on the outside of said first insulating layer to ensure adhesion between a sealing resin filled outside the high withstand-voltage electric wire and said first insulating layer. This secures by the first insulating layer the high withstand voltage required of the primary winding part and ensure adhesion between the sealing resin and the first insulating layer by the second insulating layer.

A discharge lamp lighting device according to another aspect of the present invention is characterized in that said primary winding part is disposed in a low-voltage side section of said secondary winding part. This avoids the necessity for the primary winding part to have an excessive dielectric strength that the insulation of the primary winding part would be required to possess when the primary winding part is disposed in the section on the high-voltage side of the secondary winding part; hence, a thick insulation need not be provided in the primary winding part and the high-voltage generating transformer can be minimized accordingly.

A discharge lamp lighting device according to still another aspect of the present invention is characterized in that a high-voltage side of said primary winding part is placed on a high-voltage side of said secondary winding part. With this structure, it is possible to suppress the potential difference between the primary winding part and the secondary winding part on the high-voltage side to the voltage generated in the secondary winding part, providing increased margin for the withstand voltage in the insulation of the primary winding part.

BRIEF DESCRIPTION OF THE DRAWINGS

FIG. 4(*b*) is a plan view depicting, on an enlarged scale, the winding retaining part shown in FIG. 4(*a*).

BEST MODE FOR CARRYING OUT THE INVENTION

A detailed description will be given, with reference to the accompanying drawings, of the best mode for carrying out the present invention.

Embodiment 1

Figure 1:
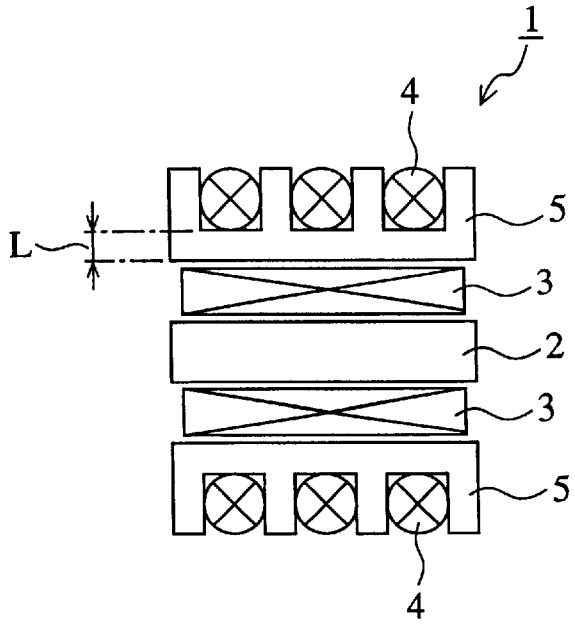
FIG.1 PRIOR ART
FIG. 1 is a sectional view showing the internal construction of a high voltage generating transformer for use as an igniter in a conventional lighting device.
Figure 2:
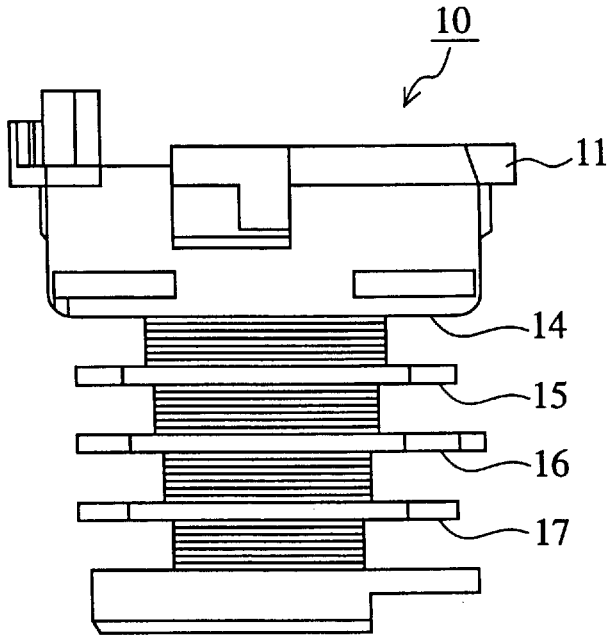
FIG. 2 is a front view showing a bobbin having a plurality of sections that is used in a high voltage generating transformer for a discharge lamp lighting device according to Embodiment 1 of the present invention.
Figure 3:
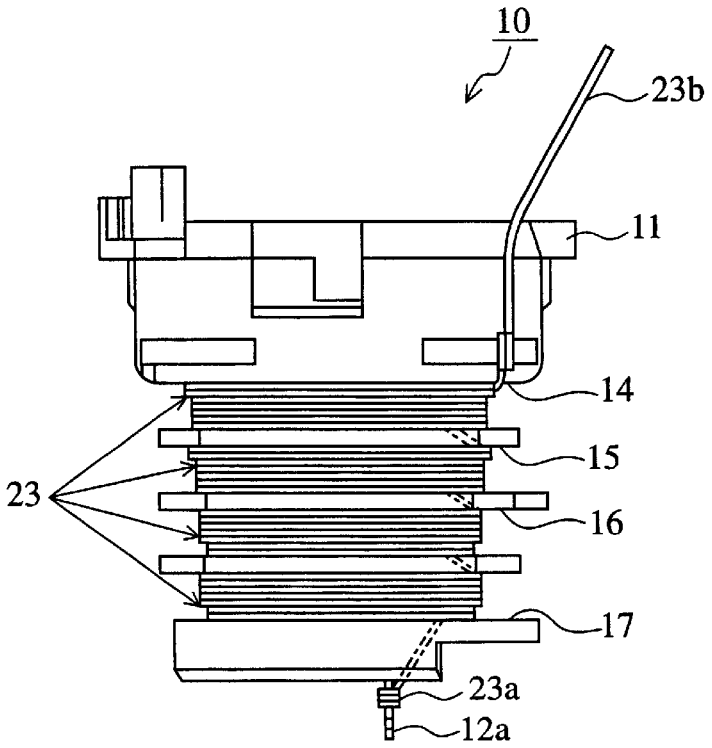
FIG. 3 is a front view depicting the bobbin with a secondary winding wound around it in the sections shown in FIG. 2.
Figure 4:
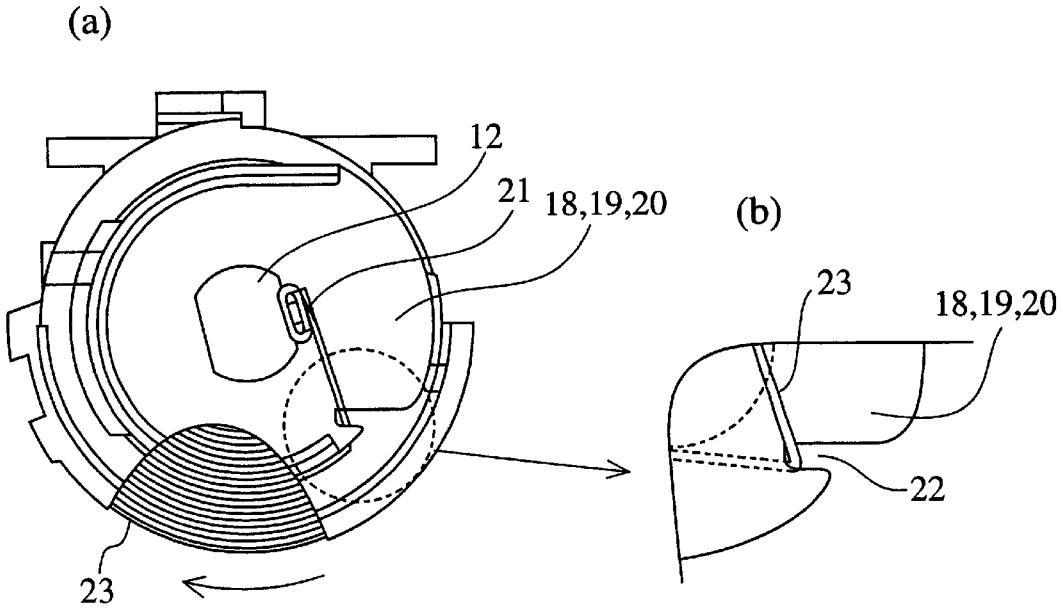
FIG. 4(*a*) is a plan view for explaining how to retain the secondary winding wound in each section shown in FIG. 2.
Figure 5:
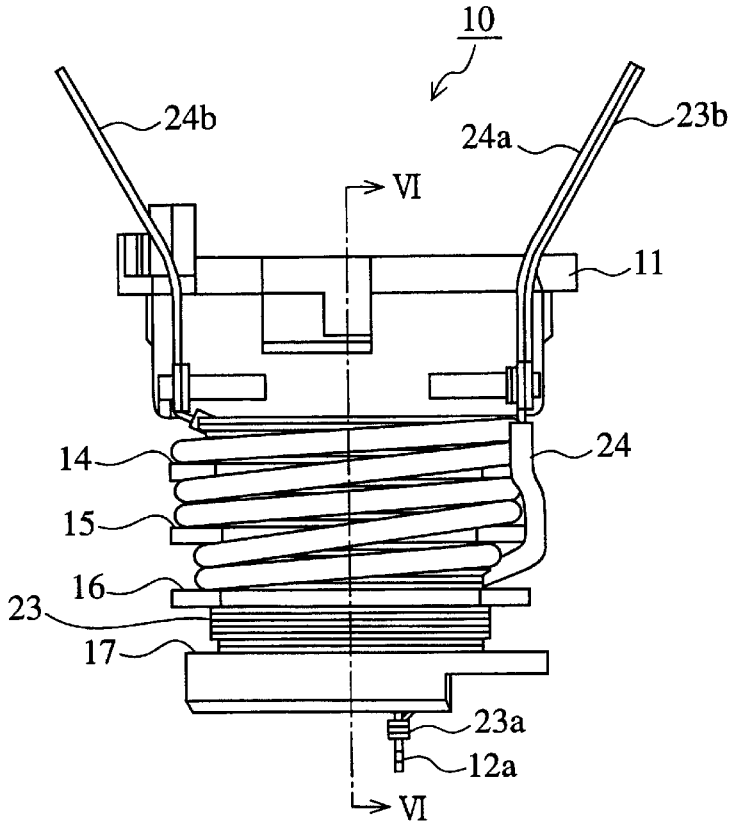
FIG. 5 is a front view of the bobbin with a primary winding wound around the secondary winding shown in FIG. 3.
Figure 6:
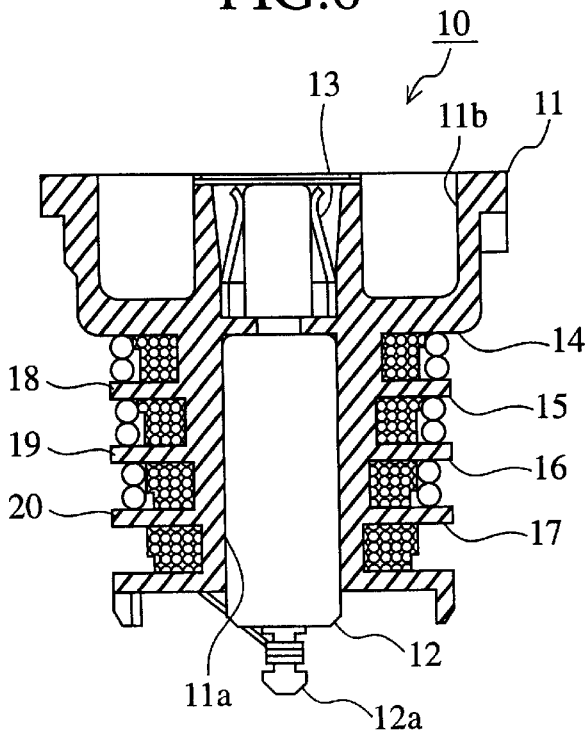
FIG. 6 is a sectional view taken along the line VI—VI in FIG. 5.
Figure 7:
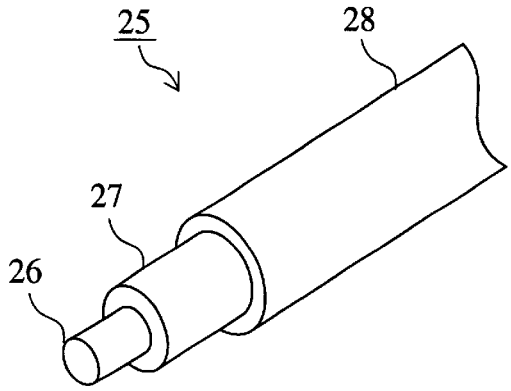
FIG. 7 is a perspective view schematically showing the internal construction of a high withstand-voltage electric wire for use as the primary winding of the high-voltage generating transformer depicted in FIG. 2.
Figure 8:
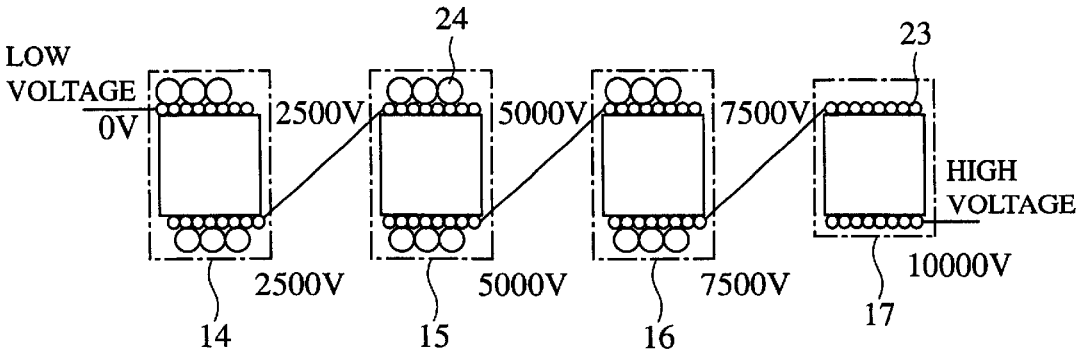
FIG. 8 is a schematic diagram for explaining the withstand voltage of the entire secondary winding wound around the bobbin for use in the high-voltage generating transformer shown in FIGS. 5 and 6 and the withstand voltage for each section.

FIG. 2 is a front view of a bobbin having a plurality of sections that is used in a high voltage generating transformer for a discharge lamp lighting device according to Embodiment 1 of the present invention; FIG. 3 is a front view of the bobbin of FIG. 2 with a secondary winding wound around it in sections; FIG. 4(*a*) is a plan view for explaining a method for retaining the secondary winding wound in the respective sections depicted in FIG. 2; FIG. 4(*b*) is a plan view showing on an enlarged scale a winding retaining part depicted in FIG. 4(*a*); FIG. 5 is a front view of the bobbin with a primary winding wound on the secondary winding depicted in FIG. 3; FIG. 6 is a sectional view taken along the line VI—VI in FIG. 5; FIG. 7 is a perspective view schematically showing the internal construction of a high withstand-voltage wire for use as a primary winding of the high-voltage generating transformer shown in FIG. 2; and FIG. 8 is a schematic diagram for explaining the withstand voltage of the entire secondary winding wound around the bobbin for use in the high-voltage generating transformer depicted in FIGS. 5 and 6 and the withstand voltage of the secondary winding for each section.

In the drawings, reference numeral 10 denotes a high-voltage generating transformer, 11 a bobbin of the high-voltage generating transformer, and 12 a core inserted in the bore 11*a* of the bobbin 11. The bobbin 11 has formed in its top end, as depicted in FIG. 6, an annular recess 11*b* for receiving a lamp-plug (not shown) that supports an HID (not shown), and in the recess 11*b* there is formed a low-voltage side terminal (not shown). A cavity formed in the top of the bobbin inside the recess 11*b* communicates with the bore 11*a* of the bobbin 11, in which there is mounted a high-voltage side terminal 13 for connection to a terminal 12*a* of the core 12. Further, the bobbin 11 has formed on its periphery a plurality (four in Embodiment 1) of winding grooves (sections) 14, 15, 16 and 17 divided axially of the bobbin as depicted in FIGS. 2, 3, 5 and 6. The depths of the winding grooves 14, 15, 16 and 17 in the axial direction of the bobbin are set to be identical, and their depths are set to increase from the groove 14 toward the groove 17 with a view to providing increased dielectric strength. Moreover, as depicted in FIG. 4(*a*), a partition wall 18 between the winding grooves 14 and 15, a partition wall 19 between the winding grooves 15 and 16, and a partition wall 20 between the winding grooves 16 and 17 each have a through hole 21 through which the winding described later is inserted between the adjacent winding grooves, and the partition walls 18, 18 and 20 each have formed in its outer marginal portion a recessed winding support part 22 by which the winding wound around each winding groove is supported in bent form as shown in FIG. 4(*b*).

A secondary winding is wound around the winding grooves from 14 to 17 to form a secondary winding part 23 as shown in FIGS. 5 and 6, which has its high-voltage side terminal 23*a* connected to the terminal 12*a* of the core 12 and has its low-voltage side end portion 23*b* routed out through the recess 11*b* of the bobbin 11. An input terminal (not shown) of the secondary winding part is connected to an output terminal 24*a* of a primary winding part 24 disposed on the outside of the secondary winding part 23, the both terminals being held equipotential. Reference numeral 24*b* denotes an input terminal of the primary winding part 24.

The primary winding part 24 is provided by winding a wire around the Bobbin in the winding grooves 14 to 16 except the winding groove 17 that is the highest voltage side of the secondary winding part 23. The primary winding part 24 is disposed in winding grooves 14 to 16 on the low-voltage side of the secondary winding part 23, but since it lies directly on the secondary winding part 23, a high-withstand-voltage wire is used as the wire forming the primary winding part 24. The high-withstand-voltage wire 25 is of the type that a conductor 26 as of copper is covered with a first insulating layer 27 to provide dielectric strength as depicted in FIG. 7. The first insulating layer 27 may preferably be formed of heat-resistant polytetrafluoroethylene in view of the fact that the primary winding is exposed to high temperatures as well as, high voltages. The polytetrafluoroethylene is a resin of the fluorine series by du Pont that is presently available in the marketplace under the trade name "Teflon." The high-withstand-voltage wire 25 is wound directly around the secondary winding part 23 and then it is sealed using an epoxy resin to prevent leakage of the high voltage generated by the transformer, but since adhesion between the sealing resin and the above-mentioned fluorine-series resin is poor, the first insulating layer needs to be covered with a second insulating layer 28 to provide appropriate adhesion as shown in FIG. 7. The second insulating layer 28 may preferably be formed using a polyester film that possesses the property of ensuring the adhesion between the two resins. Since the polyester film has the property of being incapable of extrusion, it cannot be coated directly around the first insulating layer 27. For this reason, a polyester film in tape form, for instance, is wrapped helically around the first insulating layer 27 to form the second insulating layer 28 of a predetermined thickness.

In Embodiment 1, the primary winding part 24 is disposed in the winding grooves 14, 15 and 16 on the lower voltage side of the secondary winding part 23 as described above for the reasons given below. If the primary winding part 24 is disposed in the winding groove 17 on the highest voltage side of the secondary winding part 23 as well, the primary winding part 23 is disposed substantially uniformly all over the secondary winding part 23—this enables the magnetic flux from the primary winding part 24 to cross the entire structure of the secondary winding part 23, providing increased efficiency of power transfer from the primary winding part 24 to the secondary winding part 23 and hence increasing the transformer coupling characteristic. On the other hand, when the primary winding part 24 is disposed also in the winding groove 17 that is a section for generating the highest voltage, the insulation on a wire of a dielectric strength against high dielectric breakdown becomes thick, resulting in the inconvenience of making the product bulky. Accordingly, by mounting the primary winding part 24 in the winding grooves 14, 15 and 16 on the lower voltage side of the secondary winding part 23 as described above, it is possible to attain minimization of the product while maintaining the transformer coupling characteristic.

With the structure in which the secondary winding part 23 is disposed in the winding grooves 14, 15, 16 and 17 formed as sections around the bobbin 11 and the primary winding part 24 is placed on the outside of the secondary winding part 23 in the winding grooves 14, 15 and 16, it is possible to suppress the withstand voltage for each section. That is, as shown in FIG. 8, in the case of generating a high voltage of 10000 V on the high-voltage side whereas 0 V on the low-voltage side, if the secondary winding part 23 has the same number of turns in each section, the potential difference between the beginning and end of the winding in the winding groove 14 is 2500 V, the potential difference between the beginning and end of the winding in the winding groove 15, the potential difference between the beginning and end of the winding in the winding groove 16 is 2500 V, and the potential difference between the beginning and end of the winding in the winding groove 17; that is, the potential difference in every winding groove is 2500 V. Accordingly, the insulation on the wire forming the secondary winding part 23 also needs only to have such a degree of dielectric strength as to withstand the voltage of 2500 V. Similarly, the insulation on the wire forming the primary winding part 24 also needs only to have such a degree of dielectric strength as to withstand the voltage of 2500 V. By dividing the secondary winding part 23 into a plurality of sections as described above, the dielectric strength standard of the insulation on the wire can be lowered. And, an increase in the number of sections permits generation of a desired high voltage, for instance, 10000 V.

Figure 9:
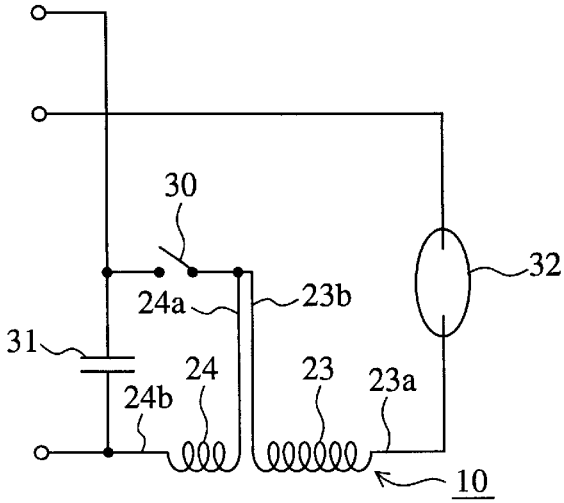
FIG. 9 is a circuit diagram illustrating the discharge lamp lighting device according to Embodiment 1 of the present invention.

FIG. 9 is a circuit diagram of a discharge lamp lighting device according to Embodiment 1 of the present invention. In FIG. 9, reference numeral 30 denotes a switching GAP (hereinafter referred to as a switch) that breaks down (dielectric breakdown), for example, on 800 V; 31 denotes a capacitor of, for example, a 0.1 $\mu$F electrostatic capacity; and 32 denotes a discharge lamp. The high-voltage generating transformer 10 in the illustrated discharge lamp lighting device has a three-terminal structure in which the output terminal 24*b* of the primary winding part 24 and an input terminal (not shown) of the secondary winding part 23 are connected. Such a high-voltage generating transformer needs to possess the two characteristics described below when it is used as an igniter for lamp lighting use.

The first characteristic is to produce a dielectric breakdown between electrodes of the discharge lamp 32 by generating therebetween a high voltage prior to lighting of the lamp. To perform this, it is desirable to generate a gentle high-voltage pulse of low voltage increase rate for easy dielectric breakdown. To attain this object, it is necessary that the transformer coupling property as a transformer characteristic be diminished to decrease the efficiency of power transfer between the primary and secondary winding parts 24 and 23 to provide a secondary winding area that is hard for the magnetic flux emanating from the primary winding part 24 to cross and provides an inductance out of the transformer coupling. A high-voltage pulse, which has its voltage increase rate lowered by such an inductance component, is used to produce a dielectric breakdown between the electrodes of the discharge lamp 32.

Incidentally, lighting of the discharge lamp 32 requires heating of electrodes of the discharge lamp and its interelectrode materials after the above-mentioned dielectric breakdown between the electrodes. Even if the dielectric breakdown is produced by the high-voltage pulse of the voltage increase rate lowered by the above-mentioned inductance component, the current subsequent to the breakdown is limited by the inductance component, and hence it does not sufficiently heat the electrodes and the interelectrode materials—this readily brings about a situation in which the heat falls short of lighting the discharge lamp and disappears although the breakdown is already produced.

The second characteristic is to rapidly heat the electrodes and interelectrode materials of the discharge lamp 32. The power for this heating is supplied from the discharge capacitor 31. What is required here is that the high-voltage generating transformer 10 be high in power transfer efficiency, that is, high in transformer coupling coefficient. With a sufficient transformer coupling coefficient, the power by the charges stored in the discharge capacitor 31 reaches the discharge lamp 32 and quickly heats its electrodes and interelectrode materials, enabling he discharge lamp to keep lighting after the dielectric breakdown between the electrodes. With a large igniter capable of producing sufficiently large power, it is possible to construct a transformer that provides a gentle voltage increase rate and permits transfer of large power, but a small igniter inevitably sacrifices a gentle pulse waveform, and to obtain an excellent lighting property with a small igniter transformer, preference must be given to the transformer coupling coefficient.

To achieve excellent lighting of, for example, a 35 W discharge lamp 32, an energy of about 20 mJ is required, and in the case of using the switch 30 and the capacitor 31 mentioned above, the transformer coupling coefficient needs to be 0.7 or more. With the transformer coupling coefficient equal to or more than 0.7, the dielectric breakdown between the electrodes of the discharge lamp 32 is followed by promoting excitation of interelectrode materials, that is, electrons and ions, keeping the discharge lamp 32 lit.

The transformer coupling coefficient T can be calculated by the following equation.

$$T=\sqrt{1-Lshort)/Lopen},$$

where Lshort is an inductance when the switch 30 is open and Lopen is an inductance when the switch 30 is closed.

The transformer coupling coefficient needs to be higher in the case of reducing the electrostatic capacity of the capacitor or the voltage of the switching GAP for the purpose of miniaturization.

Next, the operation of this embodiment will be described below.

In the first place, upon applying a 800 V voltage across the primary winding part 24 in FIG. 9, the switch 30 conducts by dielectric breakdown. As a result, magnetic flux emanates from the primary winding part 24 and crosses the secondary winding part 23, and a high voltage of, for example, 10000 V, is generated in the secondary winding part 23 by electromagnetic induction. This high voltage produces the dielectric breakdown between the electrodes of the discharge lamp 32 to light it.

Next, the power from the capacitor 31 maintains the high voltage in the secondary winding part 23, keeping its lighting.

Since the high-voltage generating transformer 10 has the three-terminal structure, the charging voltage stored in the capacitor 31 is applied to the primary winding part 24, and consequently, the charging voltage of the capacitor 31 is applied to the connection point of the primary and secondary winding parts 24 and 23. With this connection point placed in the section on the high-voltage side of the secondary winding part 23, the potential difference between the primary winding part 24 and the high-voltage secondary winding part 23 is limited only to the voltage generated by the secondary winding part 23. Conversely, if a terminal of the primary winding 24 on the non-connection point side is placed on the high-voltage side of the secondary winding part 23, the potential difference between the primary winding part 24 and the high-voltage secondary winding part 23 is the sum of the voltage by the secondary winding part 23 and the discharge voltage of the capacitor 31. Hence, the adoption of the former arrangement increases the margin of the withstand voltage of the primary winding part 24.

As describe above, according to Embodiment 1, since the secondary winding part 23 is disposed on the outside of the core 12 and since the primary winding part 24 is disposed on the outside of the secondary winding part 24, it is possible to reduce the insulation capacity in the high-voltage generating transformer and decrease the number of parts such as insulating members, achieving miniaturization of the transformer.

In Embodiment 1, since the winding grooves 14, 15, 16 and 17 as sections are formed on the outside of the core 12 and the secondary winding part 23 is formed by electric wire wound in the respective grooves 14, 15, 16 and 17, it is possible to suppress the potential difference between the beginning and end of the winding in the grooves 14, 15, 16 and 17, and the withstand voltage of the entire secondary winding part 24 can be increased by increasing the number of winding grooves.

In Embodiment 1, since the primary winding part 24 is disposed in the same space as that of the secondary winding 23 divided by the winding grooves 14, 15 and 16, it is possible to increase the power transfer efficiency from the primary winding part 24 to the secondary winding part 23 and hence improve the transformer coupling property.

In Embodiment 1, since the primary winding part 24 is disposed on the secondary winding part 23 in the winding grooves 14, 15, 16 and 17 separated as a plurality of sections, it is possible to cause the magnetic flux emanating from the primary winding part 24 to cross the secondary winding part 23 over a wide range, thereby permitting generation of a desired high voltage from the secondary winding part 23 through electro-magnetic induction.

In Embodiment 1, since the primary winding part 24 is disposed in the winding grooves 14, 15 and 16 on the low-voltage side of the secondary winding part 23, the primary winding part 24 needs not to have an excessive dielectric strength that the insulation of the primary winding part 24 would be required to possess when the primary winding part 24 is disposed also in the section on the high-voltage side of the secondary winding part 23—this allows a margin for the withstand voltage and avoids the necessity for providing a thick insulation in the primary winding part 24 and hence permits miniaturization of the high-voltage generating transformer accordingly.

In Embodiment 1, the primary winding part 24 is disposed in the winding grooves 14, 15 and 16 on the low-voltage side of the secondary winding part 23, but the primary winding pat 24 may be disposed substantially uniformly all over the secondary winding part 24 on the outside thereof. In this instance, the magnetic flux emanating from the primary winding part 24 can also be made uniform and the magnetic flux crossing the secondary winding part 24 increases to enhance the power transfer efficiency, allowing maintenance of high transformer coupling.

INDUSTRIAL APPLICABILITY

As described above, the discharge lamp lighting device according to the present invention is suitable for lighting a discharge lamp that is used as a headlight of an automobile or similar vehicle.

What is claimed is:

1. A discharge lamp lighting device, characterized by the provision of a high-voltage generating transformer comprising a core, a secondary winding part disposed in a plurality of sections on the outside of said core, and a primary winding part disposed the outside of said secondary winding part, wherein a high-voltage side terminal of said secondary winding part is connected to a terminal of said core and a low-voltage side terminal of said secondary winding part is connected to a terminal of said primary winding part.

2. The discharge lamp lighting device according to claim 1, characterized in that said primary winding is disposed substantially uniformly all over said secondary winding part on the outside thereof.

3. The discharge lamp lighting device according to claim 1, characterized in that said primary winding part is disposed in a low-voltage side section of said secondary winding part.

4. The discharge lamp lighting device according to claim 1, characterized in that a high-voltage side of said primary winding part is placed on a high-voltage side of said secondary winding part.

5. The discharge lamp lighting device according to claim 1, characterized in that said primary winding part is formed by a high withstand-voltage electric wire.

6. The discharge lamp lighting device according to claim 5, characterized in that said high withstand-voltage electric wire includes a first insulating layer covering a conductor and a second insulating layer coated on the outside of said first insulating layer, for ensuring adhesion between a sealing resin filled outside the high withstand-voltage electric wire and said first insulating layer.

* * * * *